US006131211A

United States Patent [19]

Hennessey

[11] Patent Number: 6,131,211

[45] Date of Patent: Oct. 17, 2000

[54] LOW PROFILE VACUUM TOILET

[75] Inventor: Arnold Hennessey, Wellington, Canada

[73] Assignee: FluidMaster, Inc., Anaheim, Calif.

[21] Appl. No.: 09/309,359

[22] Filed: May 11, 1999

Related U.S. Application Data

[62] Division of application No. 09/001,640, Dec. 31, 1997, Pat. No. 5,926,860.

[51] Int. Cl.[7] ..... E03D 1/06

[52] U.S. Cl. ..... 4/328

[58] Field of Search ..... 4/328, 354, 362, 4/661

[56] References Cited

U.S. PATENT DOCUMENTS

| | | | |
|---|---|---|---|
| 516,011 | 3/1894 | Harvey | 4/328 |
| 530,306 | 12/1894 | Harvey | 4/328 |
| 5,142,712 | 9/1992 | Hennessy | 4/328 X |
| 5,406,652 | 4/1995 | Hennessy | 4/354 |
| 5,426,794 | 6/1995 | Hennessy | 4/328 X |
| 5,487,193 | 1/1996 | Hennessy | 4/328 |

*Primary Examiner*—Charles E. Phillips
*Attorney, Agent, or Firm*—Richard L. Myers

[57] ABSTRACT

A vacuum assist toilet provides an efficient flushing in a tank of relatively low height. A container assembly (36) includes a largely sealed container (34) that lies within the tank (12) to hold water that is dispensed in a flushing so as to create a vacuum at the top of the tank for application to the toilet bowl outlet. The flush valve (40) lies within the container, and the lower portion of the container is isolated from tank water surrounding the container, so water used during a flushing is obtained primarily by the outflow of water within the container and through a valve seat at the bottom of the container. A baffle (130) largely surrounds the region containing the flush valve, to produce an earlier dosing of the flush valve.

4 Claims, 4 Drawing Sheets

LOW PROFILE VACUUM TOILET

This is a division of Ser. No. 09/001,640 filed Dec. 31, 1997, U.S. Pat. No. 5,926,860.

BACKGROUND OF THE INVENTION

U.S. Pat. No. 5,142,712 describes a modern vacuum assisted toilet wherein a vacuum created during a flushing, is coupled to the toilet bowl outlet to draw out the contents of the toilet bowl while water dumped into the toilet bowl pushes out the contents. The vacuum is created by placing a largely sealed container within the conventional toilet tank and allowing the water level in the container to drop as water is flushed from the tank, with the dropping water level creating a vacuum in the upper portion of the tank. Such vacuum assisted toilets allow the use of less water, as where it is decreased from 3½ gallons to 1.6 gallons, while retaining a large diameter toilet outlet such as more than 2⅛ inch, and while efficiently removing the contents of the toilet bowl.

There is a demand for low profile vacuum assist toilets, wherein the toilet tank extends a minimum height above the level of the top or rim of the toilet bowl. Where the tank is tall, such as more than fourteen inches above the top of the toilet bowl, it dispenses water with a large head, or pressure, and the water rapidly fills the bowl to efficiently flush it. If such an efficient flushing could be obtained using a tank of lower height, this would create a toilet of more attractive appearance.

SUMMARY OF THE INVENTION

In accordance with one embodiment of the present invention, a vacuum assisted toilet is provided, which creates an efficient flushing in a toilet of only moderate height. The toilet includes a largely sealed container which creates a vacuum when the water level in it drops, and a flush valve that lies within the confines of the container so water can flow rapidly out through the flush valve to the toilet bowl. At least the bottom half of the container is isolated from the surroundings to prevent the free flow of water between the bottom portion of the container and the surroundings during a flushing.

The container includes top, bottom, and side walls that are primarily sealed from the surroundings. However, the bottom wall includes a valve seat opening through which water flows towards the toilet bowl during a flushing, a water conduit for refilling the tank, and a hole through which the vacuum conduit extends. When the container lies in a tank, an inlet valve that lies in the uncontained region outside the container, flows water into the tank at each flushing to refill the tank to a predetermined high water level. The outer end of the water conduit which opens to the tank, lies a small distance below the high water level. This refills the container while assuring that little water flows from the tank to the container during a flushing, and even that water has a large head. Instead, almost all water used in a flushing flows directly from inside the container through the flush valve seat, for rapid water outflow.

A barrier lies in the container around the flush valve and ts valve seat The barrier causes most outflow in a primarily downward direction through the valve seat, and also closes the flush valve member early to provide a large head (water pressure) during almost the entire flushing when water is flowed out of the container.

The flush valve member is pivotally mounted in the container, and has a lever that is depressed to lift a seat closure part. A plunger is slideably mounted on the container and slides within a cup arrangement that extends to a lower portion of the container to avoid the escape of air or sewer gas. The container has a slot that allows the refill of the cup arrangement with water at each tank refilling, to keep the cup arrangement filled with water to assure a sewer gas seal therein.

The novel features of the invention are set forth with particularity in the appended claims. The invention will be best understood from the following description when read in conjunction with the accompanying drawings.

DESCRIPTION OF THE PREFERRED EMBODIMENT

Figure 1:
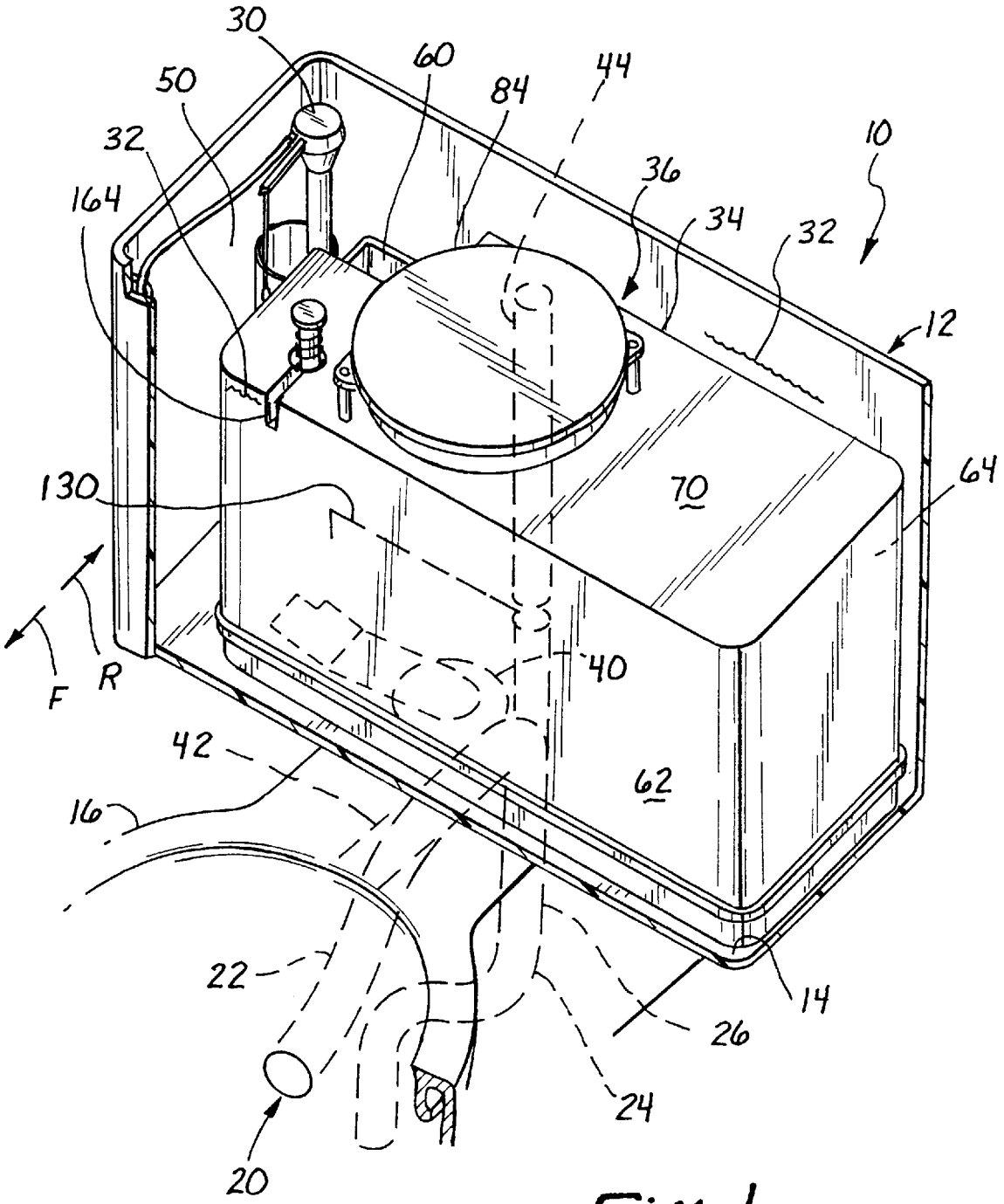
FIG. 1 is a partial sectional isometric view of a vacuum assist toilet constructed in accordance with the present invention.

FIG. 1 illustrates a vacuum assist toilet 10, which includes a conventional toilet tank 12 with a tank bottom 14. Water held within the tank is used to flush waste in a toilet bowl 16. The toilet bowl has an outlet 20 that forms an upper trap 22 and a lower reservoir 24, and a passageway 26 between them. An inlet valve 30 fills the tank to a predetermined high water level 32, with the water also filling a container 34 of a container assembly 36. When a flush valve 40 is operated, water in the tank (primarily water within the container 34) flows out through the flush valve, and through a water tunnel 42 to the toilet bowl 16 to "push" out material lying in the bowl. When the water level in the container 34 falls, it creates a vacuum in the upper portion of the container. A vacuum conduit 44 leads from the upper portion of the container to the passageway 26 of the toilet bowl outlet, to apply a vacuum thereto that "draws" out the contents of the toilet bowl. The addition of the vacuum to "draw" out the contents during a flushing, enables a given amount of water, such as 1.6 gallons, to achieve a better flushing in a vacuum assist toilet than is normally achieved by only directing water into the toilet bowl.

The volume within the toilet tank 12 may be considered to be divided between the contained volume within the container 34, and an uncontained region or volume 50 that lies within the tank but outside of the container 34. Previously, applicant not only placed the inlet valve 30 in the uncontained volume 50, but also placed the flush valve In the uncontained volume. A conduit near the bottom of the container was used to pass water into the container when the tank was refilled, and to pass water from the container into the uncontained volume and through the flush valve during a flushing. Applicant found that a tall tank was required for a flushing of given effectiveness (a predetermined number of light and heavy balls in the toilet bowl are flushed). The high tank allowed water with a large head (large pressure) to flow from the tank area around the container rapidly down through the outlet valve, while also causing a moderately rapid outflow of water from the container to produce a vacuum therein. A toilet tank of lower height is generally desirable, and applicant has changed the design of his vacuum assist toilet to achieve this.

In accordance with one aspect of the invention, applicant now places the flush valve 40 within the container 34, rather than in the uncontained volume 50 lying within the tank but outside of the container. This has two advantages. A first advantage is that there is little obstruction to the rapid outflow of water from the container through the flush valve 40 into the water tunnel 42, for most of the water. The virtually unrestricted outflow of water from the container through the flush valve 40 results in a very rapid outflow of water, that would otherwise require a taller container and taller tank. A second advantage is that almost all water used in a flushing flows out from the container 34, where the vacuum is generated that is applied to the trapway 26 of the toilet bowl outlet. As a result, a vacuum of larger negative pressure and volume is created for application to the passageway 26 to better draw out the contents of the toilet bowl.

For the present application, applicant prefers to place the inlet valve 30 in the uncontained volume 50 lying outside of the container 34. This allows a conventional toilet inlet valve 30 to be used in a simple manner. A water conduit 60 flows water from the uncontained volume 50 into the container 34 to refill it after each flushing.

Figure 2:
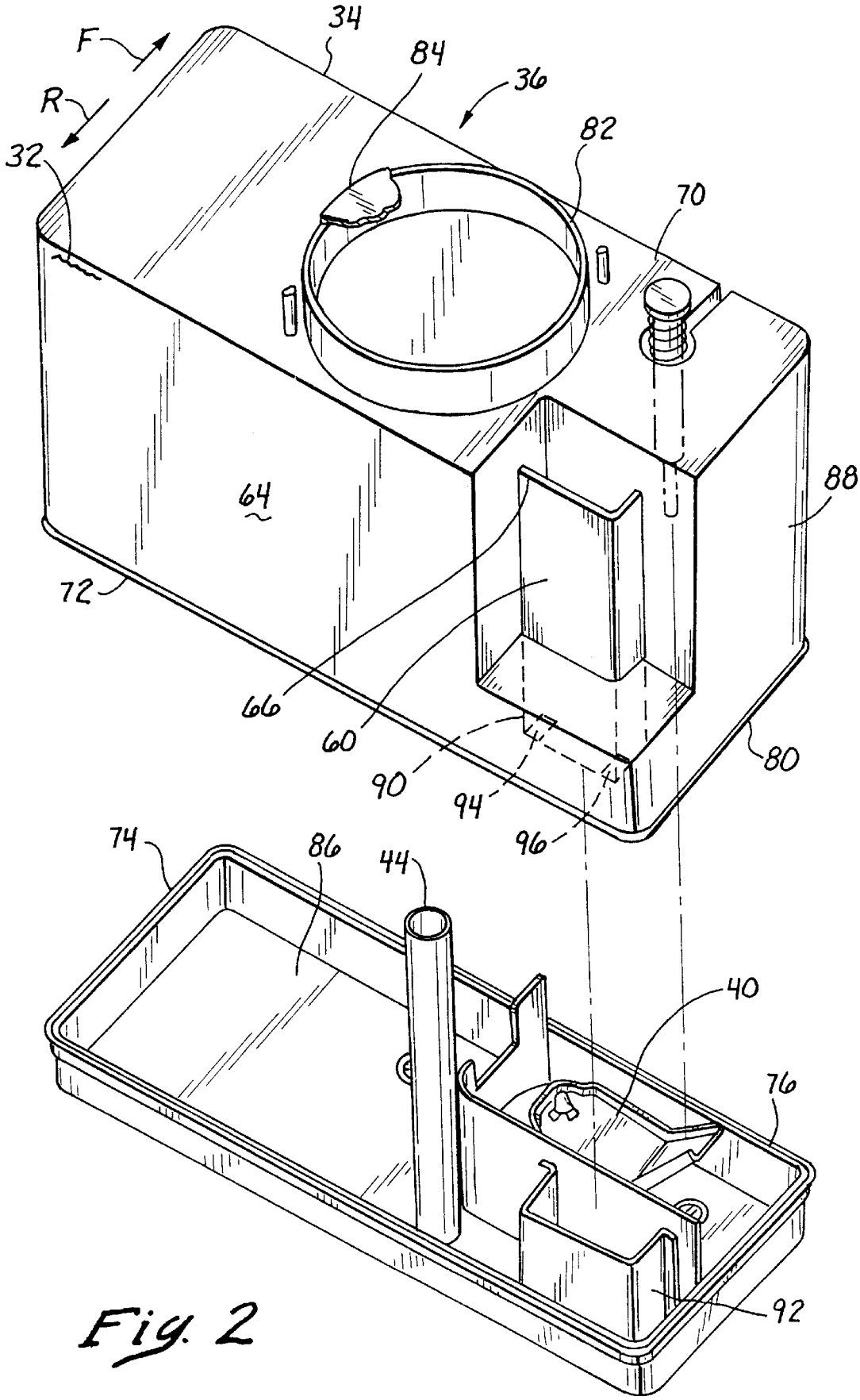
FIG. 2 is an exploded isometric view of the container assembly of the toilet of FIG. 1.

FIG. 1 shows the front wall 62 of the container, with the conduit 60 lying at the rear wall 64. FIG. 2 shows the rear wall 64 of the container, to better show the conduit 60. The high water level 32 in the tank, lies at about the top of the container 34. The water conduit 60 has a top 66 that lies five-eighths inch (1.6 cm) below the top wall 70 of the container. As a result, water in the uncontained volume outside the container, falls only about one-half inch during a flushing, to the level of the conduit top 66. After a flushing, when the inlet valve opens, almost all of the water entering the tank overflows the conduit top 66 and refills the container, with additional water being used to fill the container and the uncontained volume about one-half inch to the high water level 32.

It can be seen from FIG. 2, that the container 34 includes upper and lower container parts 72, 74. The lower container part forms a groove 76 into which a tongue 80 of the upper part fits, the tongue 80 lying at the bottom of the upper container part. This holds the container parts together and allows them to be forcefully separated. The container has a bottom wall 86, the front and rear walls 62, 64, and end walls 88. The container includes a neck 82 that projects up from the top wall 70, and a cap 84 that fits over the neck and forms an air tight seal thereat. The neck 82 is of large diameter, and the cap 84 can be removed to observe, clean, and replace parts, especially the flush valve, within the container. The top of the vacuum conduit 44 extends into the neck 82 to leave the top of the vacuum conduit about as high as possible.

Figure 4:
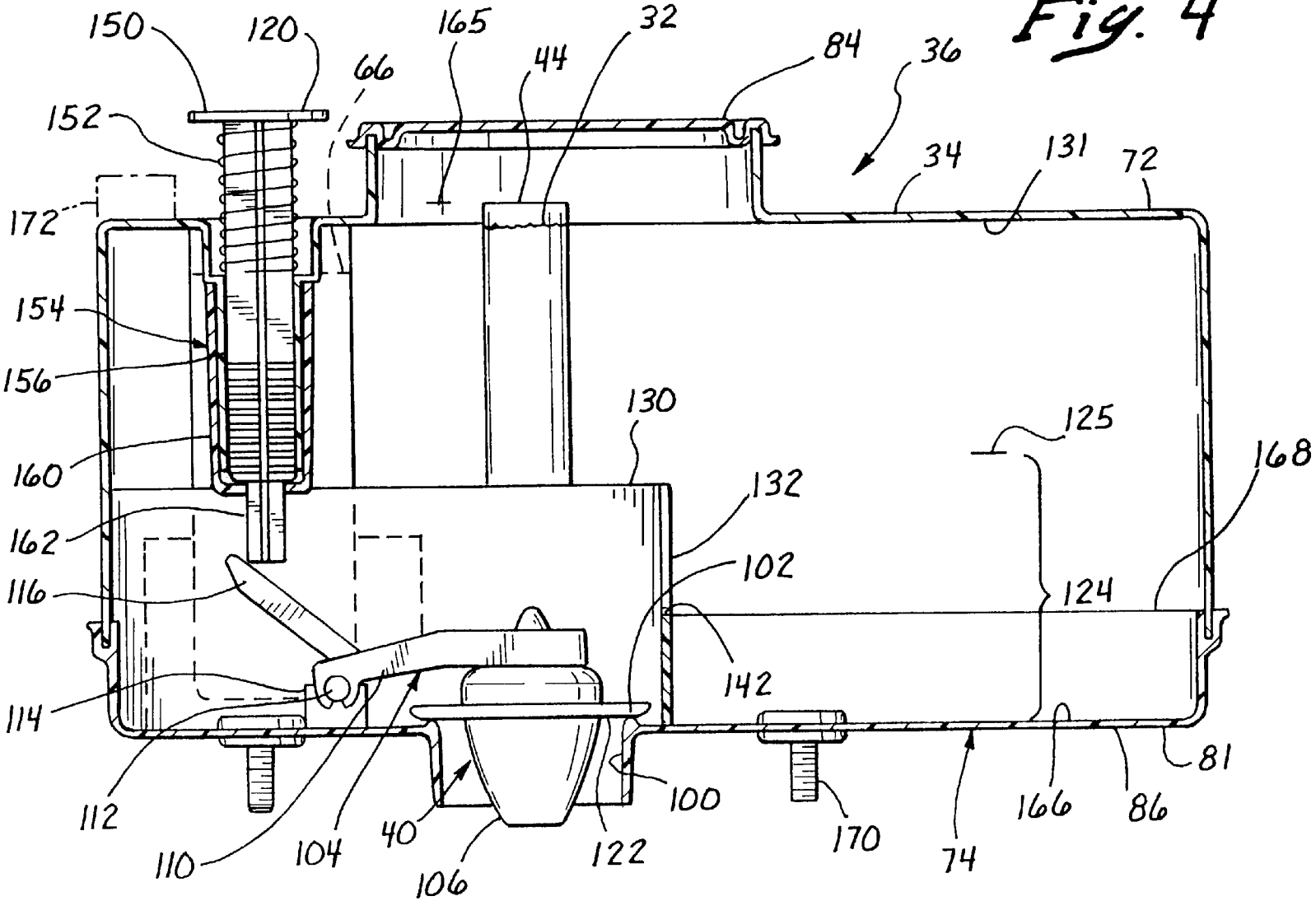
FIG. 4 is a side sectional view of the container assembly of FIG. 3.

The water conduit 60 includes a depending part 90 that is received in a trap 92. The water conduit has openings only at 94, 96 that lie deep within the trap 92. The trap 92 contains water at all times (during and between flushings), and assures that any sewer gas that enters the container 34, will not escape into the uncontained volume of the tank and into the environment FIG. 4 shows some details of the flush valve 40 and of the rest of the container assembly. The container forms a seat opening 100 through which water is released to flow through the water tunnel to the toilet bowl, with the bottom wall also forming a valve seat 102. A flush valve member 104 includes a float 106 and a yolk 110 that is pivotally mounted on a pair of trunions about an axis 112. The trunions lie on brackets 114 extending up from the bottom wall 86. A lever 116 can be depressed by a plunger 120 to pivot up the rest of the float valve member, including a seat closure part 122 that extends around the float 106. When the seat closure part 122 has lifted a certain distance off the valve seat, the buoyancy of the float 106 raises the valve member high above the valve seat, as in common practice. When the flush valve member has been operated, water in the large container chamber enclosure 131, which is initially at the high water level 32, rapidly moves out through the valve seat 102 and seat opening 100 towards the toilet bowl. There is little restriction to the rapid outflow of water from the container chamber 130, so the outflow is rapid. The outflow is, on average, as rapid as would previously require a much taller tank.

The lower half 124 of the container is isolated from the uncontained volume 50 lying around the container, so water cannot flow largely horizontally from the bottom portion (below level 125 which is half the high water level) of the uncontained volume into the container during a flushing. Substantial isolation (there is no passage with an opening greater than one-fifth the area of the seat 102) also assures that at least 75% of the flush water comes from water stored in the container between flushings.

Applicant initially constructed the container assembly so there was no barrier around the valve seat 102 and flush valve member 104. Applicant then placed a barrier similar to the barrier 130, around the flush valve member 104 and valve seat 102, to prevent the outflow of water lying only perhaps two inches above the valve seat 102. Such "last two inches" of water has only a small head, so it flows relatively slowly out through the valve seat 102 and does not help much in a flushing as compared to its volume. Applicant found that when the barrier extended completely around the flush valve member, that the flow was directed downward along the flush member and closed it at the beginning of a flushing. To prevent this, applicant provides a barrier slot 132 in the barrier 130, at a location near the seat closure part 122 of the flush valve member, and preferably at a location opposite the pivot axis 112. The barrier slot 132 allows the rapid flow of some water through the valve seat 102 without pushing down the raised flush valve member, so the flush valve member does not close much too early.

Figure 3:
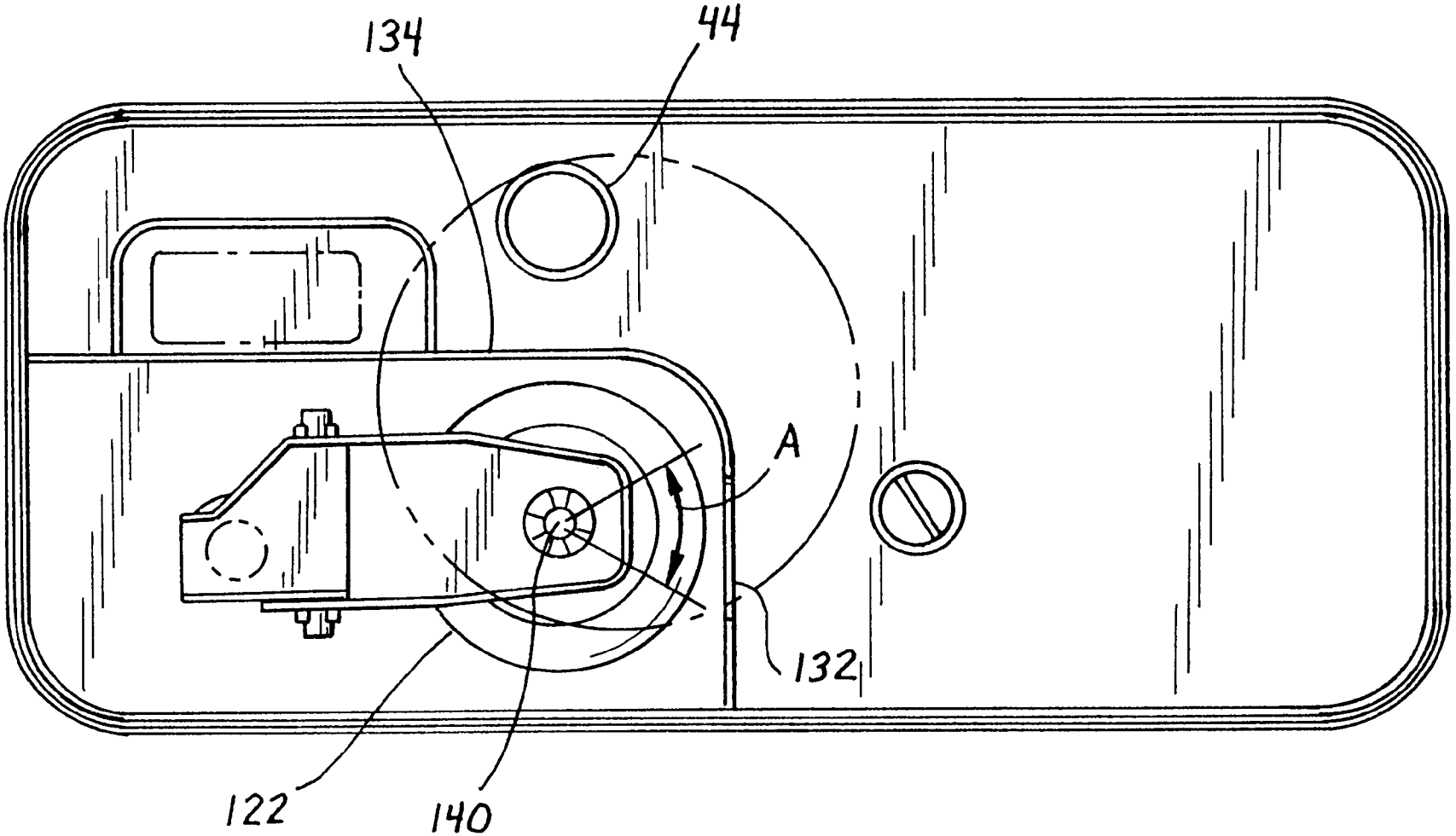
FIG. 3 is a plan view of the lower portion of the container assembly of FIG. 2.

FIG. 3 shows the center or axis 140 of the valve seat and seat closure part 122, and shows that the barrier slot 132 extends by an angle A of 60°. This leaves the tall barrier portion 134 to surround the valve member by more than 200°, and actually about 300°. Applicant found that the angle A of 60° enables sufficient largely horizontal flow below the raised flush valve member, that the valve member does not close too early during a flushing. However, the valve member closes earlier than without the baffle, with the particular container assembly closing with 1¾ inch (4.5 cm) of water still lying in the container (above the surface 166). It may be said that with the barrier (of at least 2 inches height), the barrier slot allows fine adjustment of the height at which the flush valve closes, to produce a 1.6 gallon (6 liter) flush. As shown in FIG. 4, the barrier lies at a level 142 of 1¾ inch at the slot 132, to prevent excessive horizontal and slow flow into the valve seat The average height of the barrier is preferably at least one inch above the sealed surface of the valve seat. As shown in FIG. 3, the vertical cross-section of the area within the barrier, as seen in a vertical or plan view, is less than half the total cross-sectional area of the container.

The plunger 120 has a top 150 which is depressed to lift the seat closure part 122 of the flush valve member 104 off the valve seat and begin a flushing. A spring 152 urges the plunger upwardly. A cup arrangement 154 includes a stationary guide 156 that is formed by the container top wall and that surrounds the plunger. A cup 160 is fixed to a lower portion 162 of the plunger to move up and down with it. The cup 160 serves to hold water, to prevent any sewer gas that flows backward into the container 34, from flowing into the uncontained region of the tank and into the environment. Such sewer gas could flow backward through the vacuum conduit 44. As shown in FIG. 1, applicant provides a slot 164 in the top wall 70 and front wall 62, to allow water to refill the cup arrangement 154 (FIG. 4) every time the tank is refilled. The bottom of the slot 164 is at the same level as the top of conduit 60, which is slightly below the minimum water level in the filled tank.

Applicant has constructed a container assembly 34 of the construction illustrated, with the container constructed to hold water of a high water level 32 only 6½ inches (16.5 cm) above the bottom surface 81 of the container (bottom surface 81 of FIG. 4 lies on the bottom 14 of the tank). The average height 165 of the container inside was about 6.8 inch (17.3 cm). The total height of the container was 7¾ inches (19.8 cm) between the bottom surface 81 and the top of the cap 84. An additional three inch height was required for the inlet valve and tank cover, resulting in a tank whose top was only eleven inches above the bottom 14 of the tank and of the rim of the toilet bowl. The barrier 130 extended 2¾ inches (7 cm) above the container bottom wall upper surface 166, except at slot 132 where the barrier height was 1¾ inch (4.5 cm). The barrier as shown in FIG. 3, had a length of 6.5 inches and width of 3¼ inches, compared to the container length of 13 inches and width of 5¾ inches. The top 168 of the container lower part 74 lay 1.8 inch (3.3 cm) above the upper surface 166 of the container bottom wall. The seat top 102 lay about 0.5 cm above the container surface 166.

About 90% of the water used in each flushing came from water stored in the container between flushings, with about 10% resulting from water in the uncontained volume lying outside the container, flowing in through the water conduit near the beginning of a flushing (after water in the container dropped a couple of inches).

In FIG. 2, the openings 94, 96 at the bottom of the water conduit 60 were of a small size, having a combined open area of only about 0.4 square inch (2.6 $cm^2$), which is less than one-fifth the area of the valve seat, which was of 2⅛ inch diameter (area of 3.5 square inches or 23 $cm^2$). This assured that during the beginning of a flushing, water flowed only slowly from the tank into the container, while water flowed rapidly out of the container, to assure that the level of water in the container dropped rapidly near the beginning of a flushing to create a vacuum to draw out the contents of the toilet bowl.

It is noted that FIG. 4 shows a pair of mounting bolts 170 that mount the container rigidly in place in the tank. An additional pair of brackets, indicated at 172 can be formed on the top wall of the container to hold a mechanism that depresses the plunger 120.

Thus, the invention provides an improved vacuum assist toilet, which enables the very rapid outflow of water from within the tank towards the toilet bowl, so that a tank of smaller height can be used and still provide a vigorous outflow of water for an efficient flushing. The valve seat through which water flows out of the tank, is formed at the bottom of a vacuum-generating container, so water can flow to the valve seat with virtually no restriction, for very rapid outflow. The container is sealed against the flow of water from the uncontained volume around the container, into the container, at least in the bottom half of the container. The container is stationary and the flush valve member is preferably mounted within the container and pivotally mounted at the bottom of the container. The inlet valve can lie outside the container, and a water conduit is provided to refill the container, with the upper end of the water container lying only slightly below the high water level.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A method for operating a vacuum assist toilet having a toilet bowl with a toilet bowl outlet, a tank, a container disposed within said tank, and a vacuum conduit extending from an upper portion of the container to said toilet bowl outlet, so that a vacuum is created in an upper portion of the container and applied to the toilet bowl outlet as the water level within the container falls during a flushing of water into said toilet bowl, the method comprising the steps of:

during the flushing of water, directing the water from said container into the said toilet bowl without first passing said water out of said container through said tank;

after the flushing of water, refilling said tank through an inlet valve disposed in said tank but outside said container;

during the refilling step, allowing said water to flow from said tank into said container; wherein said step of flushing water includes isolating said container from said tank so that water at a level below half the height of said tank is inhibited from flowing into said container.

2. A method for operating a vacuum assist toilet having a toilet bowl with a toilet bowl outlet, a tank, a container disposed within said tank, and a vacuum conduit extending from an upper portion of the container to said toilet bowl outlet, so that a vacuum is created in an upper portion of the container and applied to the toilet bowl outlet as the water level within the container falls during a flushing of water into said toilet bowl, the method comprising the steps of:

during the flushing of water, directing the water from said container into the said toilet bowl without first passing said water out of said container through said tank;

after the flushing of water, refilling said tank through an inlet valve disposed in said tank but outside said container;

during the refilling step, allowing said water to flow from said tank into said container;

forming said container with a bottom wall and sidewalls which substantially isolate the interior of said container from said tank at the lower half of said tank;

establishing a seat opening in said bottom wall of said container and providing a valve seat on the seat opening; and establishing a flush valve member in said container.

3. The method recited in claim 2, further comprising the step of:

during the directing, flowing water from said container down through said seat opening to said toilet bowl during the flushing of water while avoiding the passage of water from the bottom of said tank to said seat opening.

4. The method recited in claim 2, further comprising the steps of:

during the flowing step, flowing said water through said flush-valve seat while said flush-valve member is raised above said flush-valve seat;

establishing a barrier with a height not greater than 4 centimeters at least 200° around said flush-valve seat and around at least said lower portions of said flush valve; and during the flushing of water, directing most of the water into said barrier before directing the water through said flush-valve seat.

* * * * *